US005222720A

United States Patent [19]

Newsome

[11] Patent Number: 5,222,720

[45] Date of Patent: Jun. 29, 1993

[54] HOPPER WITH THIRD LIFTER

[76] Inventor: John R. Newsome, c/o SIM Products, R.R. #1, Box 58A, Shumway, Ill. 62461

[21] Appl. No.: 824,041

[22] Filed: Jan. 23, 1992

Related U.S. Application Data

[63] Continuation-in-part of Ser. No. 572,765, Aug. 27, 1990, now U.S. Patent 5,088,711, Feb. 18, 1992.

[51] Int. Cl.[5] ..... B65H 39/02; B65H 1/24

[52] U.S. Cl. ..... 270/54; 270/58; 271/166; 414/795.8

[58] Field of Search ..... 270/54, 58; 271/35, 271/101, 157, 165, 166; 414/795.8, 797.6, 797.7

[56] References Cited

U.S. PATENT DOCUMENTS

| | | | |
|---|---|---|---|
| 3,503,606 | 3/1970 | Castellanet | 271/166 |
| 3,672,668 | 6/1972 | Keulen | 271/166 X |
| 3,683,758 | 8/1972 | Feldkamper . | |
| 3,690,650 | 9/1972 | Maier . | |
| 3,752,361 | 8/1973 | VanLinder et al. | 414/797.5 X |
| 3,767,189 | 10/1973 | Kopp | 271/166 |
| 3,900,115 | 8/1975 | Kumagai . | |
| 3,905,490 | 9/1975 | Johnson . | |
| 3,955,686 | 5/1976 | Kumagai . | |
| 4,021,032 | 5/1977 | Gross et al. | 271/166 |
| 4,049,259 | 9/1977 | Ventz . | |
| 4,397,459 | 8/1983 | Silverberg et al. | 271/166 X |
| 4,531,724 | 7/1985 | Lukas et al. | 271/166 |
| 4,771,896 | 9/1988 | Newsome . | |
| 4,981,292 | 1/1991 | Cosgrove . | |
| 5,137,264 | 8/1992 | Cloutier et al. | 270/54 X |

FOREIGN PATENT DOCUMENTS

| | | | |
|---|---|---|---|
| 961520 | 1/1975 | Canada . | |
| 2326282 | 12/1974 | Fed. Rep. of Germany | 271/165 |

*Primary Examiner*—Edward K. Look
*Assistant Examiner*—John Ryznic
*Attorney, Agent, or Firm*—Leydig, Voit & Mayer

[57] ABSTRACT

Magazine signatures which are manually loaded as a stack into a product hopper are stripped therefrom by conveyor belts and are conveyed as a running shingle having a relatively large setback and a relatively thin vertical cross-section. To assist in establishing such a shingle, lifters periodically raise an upper group of signatures of the stack in the hopper from the lower signatures to reduce the weight on the latter signatures and prevent the lowermost signature from pulling along the immediately overlying signature as the lowermost signature is stripped from the hopper.

11 Claims, 4 Drawing Sheets

AIR
FLOW
VAC
X

HOPPER WITH THIRD LIFTER

CROSS-REFERENCE TO A RELATED APPLICATION

This application is a continuation-in-part of my copending application Ser. No. 572,765, filed Aug. 27, 1990.

BACKGROUND OF THE INVENTION

The present invention relates to a machine for transporting paper signatures or the like to a processing line such as might be associated with a binding machine.

Conventionally, the pages of magazines are supplied from the printing operation to the binding operation in the form of several groups of signatures, a signature being a multiple sheet folded assembly having a spine defined by the folded margin. At the binding operation, the groups of signatures are collated and bound to form the magazine.

In some binding operations, the groups of signatures are supplied to the bindery on pallets. Workers lift stacks of signatures from the pallets and place the stacks into receiver hoppers which supply the collating conveyors of a binding machine. During lifting and placing of the stacks, the workers fan and massage the signatures to loosen the signatures and help keep the newly printed signatures from sticking together during further processing. Repetitive placing of the signatures and fanning and massaging of the signatures over a long period of time can lead to carpal tunnel syndrome.

Machinery exists for automatically stripping signatures from a stack and for transporting the signatures to further processing apparatus. By way of example. Newsome U.S. Pat. No. 4,771,896 discloses a machine in which signatures in a stack are formed into a first running shingle having a rough and non-uniform setback between adjacent signatures in the shingle. The signatures of the first running shingle are collected in a stack and then are formed into a second running shingle having a substantially uniform setback which is significantly greater than that of the first shingle.

SUMMARY OF THE INVENTION

The general aim of the present invention is to provide a new and improved signature transporting machine in which a power-driven conveyor strips signatures one-by-one from a stack in a hopper and feeds the signatures from the hopper as a running shingle having a comparatively large setback between adjacent signatures, the shingle thereby having a relatively think cross-section. By establishing such a shingle as the signatures are stripped from the hopper, further downstream handling of the signatures may be reliably effected without need of creating a second shingle with a uniform setback.

A more detailed object of the invention is to create a shingle with a relatively large setback by relieving the weight of the upper signatures in the hopper from the lower signatures whenever the conveyor is stripping signatures from the hopper so as to insure against the signatures sticking together and to promote a large setback between adjacent shingles. Moreover, such lifting of the signatures reduces or eliminates the need for manually massaging and fanning the signatures and thus reduces worker fatigue and the likelihood of carpal tunnel syndrome.

A further object of the invention is to lift the upper signatures in the stack from the rear and from two sides so as to relieve substantial weight from the lower signatures while maintaining good control over the lifted signatures.

Still another object is to provide a unique lifting mechanism which tends to roll gently into the signatures at the start of the lifting operation so as to avoid damaging the signatures.

These and other objects and advantages of the invention will become more apparent from the following detailed description when taken in conjunction with the accompanying drawings.

DETAILED DESCRIPTION OF THE PREFERRED EMBODIMENT

Figures 1, 2:
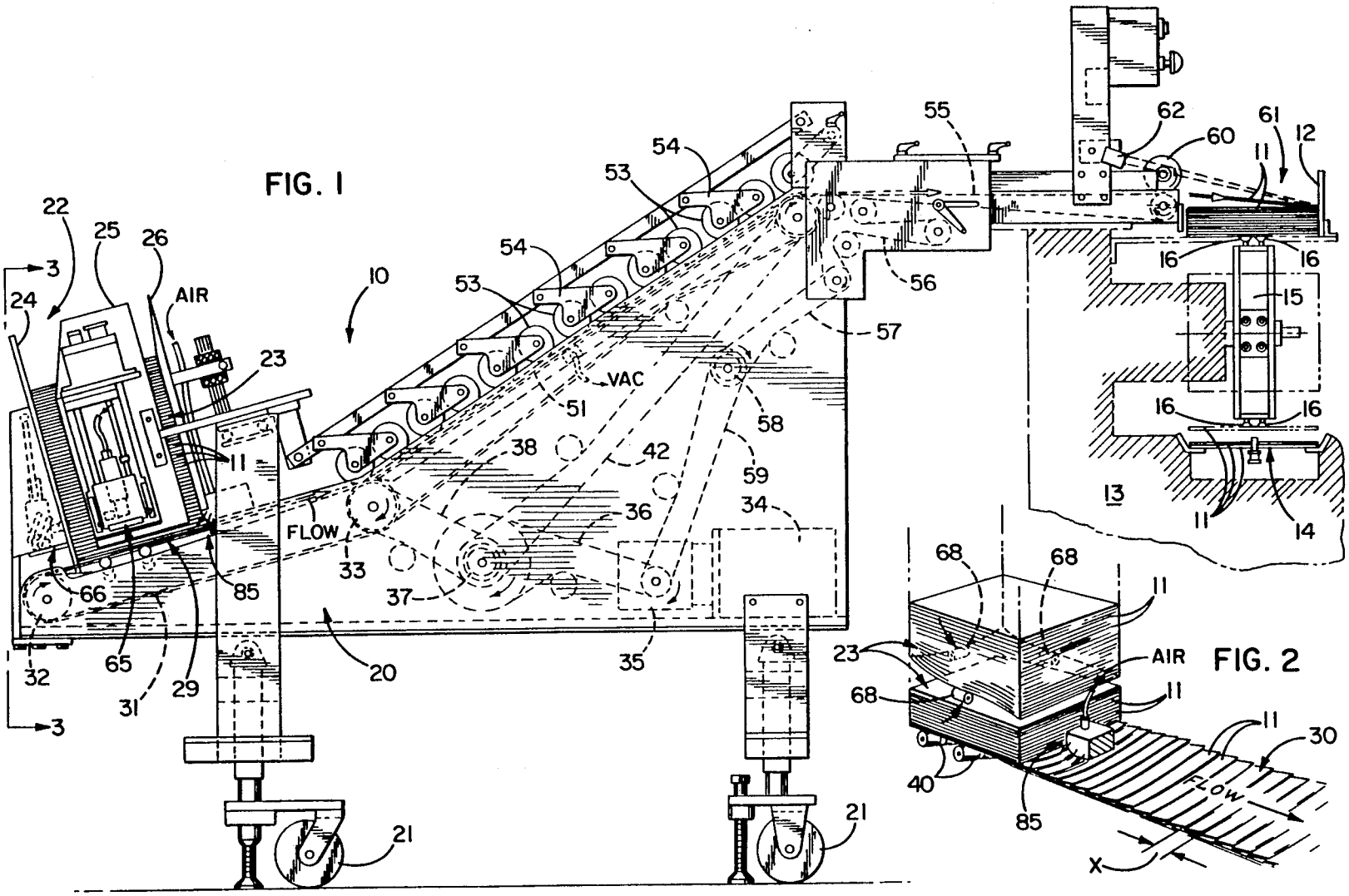
FIG. 1 is a side elevational view of a new and improved signature transporting machine incorporating the unique features of the present invention.
FIG. 2 is a perspective view which schematically shows signatures being stripped from the hopper of the machine and formed into a shingle.

For purposes of illustration, the invention has been shown in the drawings as incorporated in a machine 10 for transporting so-called signatures 11 to the receiver hopper 12 of a binding machine 13 having a conveyor 14 for collecting and collating the signatures and for advancing the collated signatures to the binding section of the machine. A signature typically is formed by four double-sided magazine pages which are folded along one margin called a spine. The signatures may, however, have a larger or smaller number of pages.

In this particular instance, the collating conveyor 14 includes a series of spaced pockets adapted to be advanced continuously beneath the receiver hopper 12 and adapted to receive the signatures 11 from the hopper. The signatures are transferred from the hopper 12 to the pockets by a continuously rotated drum conveyor having suction cups 16 which, when at the twelve o'clock position, grip the underside of the lowermost signature in the overlying hopper. As the drum is rotated, the suction cups strip the signature from the hopper and then release the signature and drop the signature into an underlying pocket of the conveyor 14 as the cups reach the six o'clock position. As disclosed in more detail in the aforementioned parent application, several transporting machines 10 serve the conveyor 14, the signatures supplied by the machines being collated by the conveyor and being delivered by the conveyor to the binding section of the binding machine 13.

The machine 10 includes a framework or base structure indicated generally by the reference numeral 20 and supported on wheels 21. Supported on the base 20 is a product hopper 22 adapted to hold a stack 23 of signatures 11 which are manually loaded into the hopper. The product hopper 22 is generally rectangular in cross-section and is formed by an upright rear plate 24 (FIGS. 3 and 4), a pair of upright side plates 25 and an upright front plate 26.

The bottom of the product hopper 22 is defined by an infeed conveyor 29 which strips the signatures 11 one-by-one from the lower end of the stack 23 in the hopper and forms the signatures into a running shingle 30 (FIG. 2). As is well known, a shingle is a row of overlapping signatures which are arranged such that the trailing end portion of a leading signature underlies the leading end portion of the immediately trailing signature. The distance X (FIG. 2) between the leading edges of adjacent signatures is commonly called the shingle setback.

Figure 4:
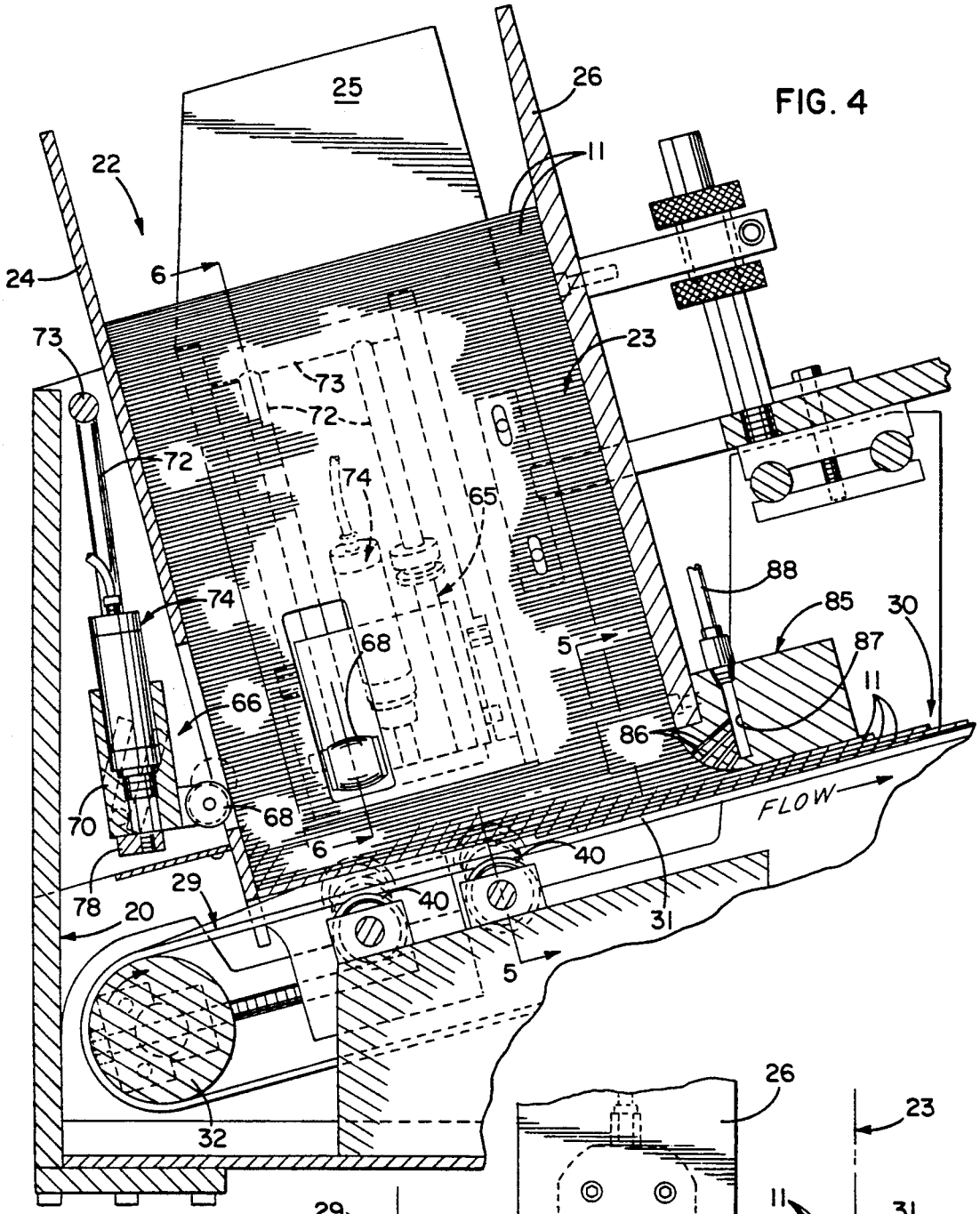
FIG. 4 is a fragmentary cross-section taken substantially along the line 4—4 of FIG. 3.
Figure 5:
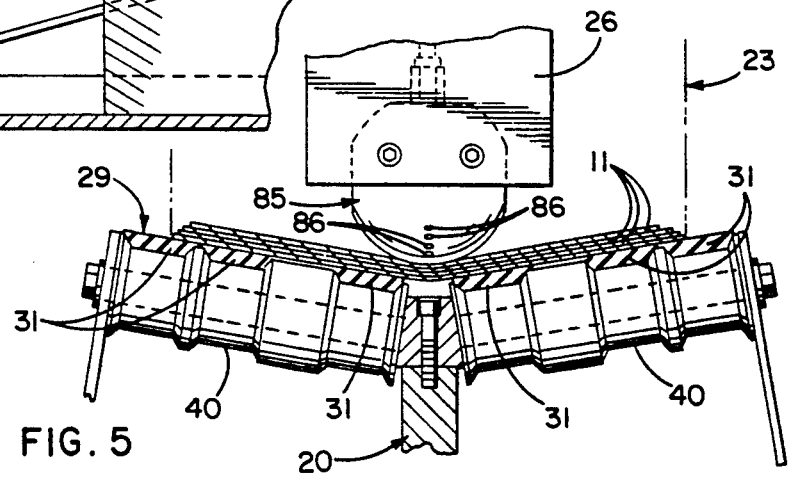
FIGS. 5 and 6 are enlarged fragmentary cross-sections taken substantially along the lines 5—5 and 6—6, respectively, of FIG. 4.

Herein, the infeed conveyor 29 is formed in part by six laterally spaced rubber belts 31 (FIG. 5). The belts are trained around an upstream sheave 32 (FIG. 4) located adjacent the rear of the hopper 22 and have upper active runs which extend beneath the stack 23 of signatures 11 in the hopper. The belts curve around a downstream sheave 33 (FIG. 1) before returning to the sheave 32. In this particular instance, the belts are inclined upwardly at about a 15 degree angle while the hopper 22 is disposed perpendicular to the belts and thus is inclined rearwardly at about a 15 degree angle relative to vertical.

Driving of the belts 31 is effected by rotating the sheave 33. For this purpose, a motor 34 acts through a speed reducer 35 and a chain 36 to drive the input of an electrically controlled clutch 37. A chain 38 is connected to the output of the clutch and is trained around a sprocket which is connected to rotate with the sheave 33. The belts 31 are driven whenever the clutch 37 is engaged and are stopped when the clutch is disengaged.

As shown in FIGS. 4 and 5, front and rear pairs of mutually inclined rollers 40 are located beneath the hopper 22. The upper active runs of the belts 31 pass across the rollers and, as the active runs pass from the rollers of the rear pair to the rollers of the front pair, they are formed into a V-shaped configuration as shown in FIG. 5. Signatures 11 at the lower end portion of the stack 23 are forced against the belts and into the same V-shaped configuration by the weight of the signatures in the upper portion of the stack. By thus bowing the signatures upwardly, the signatures tend to separate from one another to facilitate stripping of the lowermost signature from the stack by the belts.

The shingle 30 on the belts 31 is transferred to and is picked up by a vacuum belt 51 (FIG. 1) which is inclined upwardly at a steeper angle than the belts 31. A chain 42 leads from the output of the clutch 37 to a sprocket at the downstream end of the vacuum belt in order to drive the latter belt whenever the stripping belts 31 are driven. Wheels 53 supported on pivoted arms 54 engage the side edges of the signatures 11 and maintain the lateral positioning of the signatures as they are carried upwardly by the vacuum belt 51.

The signatures 11 from the vacuum belt 51 are picked up by an outfeed conveyor 55 for delivery to the receiver hopper 12 of the binding machine 13. The outfeed conveyor extends horizontally and is driven by a chain 56 which, in turn, is driven by a chain 57 connected to the output of a clutch 58. The input of the clutch is driven by a chain 59 which is connected to the speed reducer 35.

As the signatures 11 advance to the downstream end of the outfeed conveyor 55, they pass beneath an accelerator wheel 60 (FIG. 1) which is rotated continuously at a constant speed. The wheel launches each signature forwardly into the receiver hopper 12 so as to cause a stack 61 to be formed therein. To detect the height of the stack 61, a photocell 62 is mounted on a fixed structure upstream of the hopper 12 and directs a light beam toward a reflector (not visible) at the forward end of the hopper. When the stack 61 is above a preselected level, the stack prevents the light beam from striking the reflector. As the stack falls below the reflector, reflection of the beam back to the photocell 62 causes the latter to produce an electrical signal. In this case, the signal is used to energize the clutches 37 and 58 and effect movement of the belts 31, the vacuum belt 51 and the outfeed conveyor 55 so as to cause additional signatures to be fed to the hopper 12. When the stack 61 rises to a level to block reflection of the beam, a timer is set by a signal from the photocell and, after a short delay, times out and effects de-energization of the clutches so as to stop the feeding of signatures into the hopper 12. In this way, the signatures are fed to the hopper 12 in very short bursts in order to keep the height, and thus the weight, of the stack 61 low. The stack 61 is kept at a height of between one to four inches and, as a result, the signatures are not significantly compressed by their own weight and thus may be stripped consistently and individually from the hopper 12 by the rotary conveyor 15.

In order for the continuously driven accelerator wheel 60 to consistently launch signatures 11 one at a time into the receiver hopper 12, it is not necessary for the setback X of the signatures in the shingle 30 to be precisely uniform from signature-to-signature. It is, however, necessary that the setback be relatively large (e.g., 2 inches) and that the vertical cross-sectional dimension of the shingle be relatively thin so that the wheel will only launch one signature at a time. If more than one signature is launched simultaneously, the trailing signature may collide with the leading signature and disrupt the integrity of the stack 61.

In accordance with the present invention, a shingle 30 of relatively thin cross-section and with a comparatively large and rather uniform setback is established as the signatures 11 are stripped from the upstream product hopper 22, such a shingle being promoted by lifting the uppermost signatures 11 in the stack 23 and thereby reducing the weight on the lowermost signatures so that the latter may be stripped easily and uniformly from the hopper 22. By establishing a shingle with a comparatively large setback at the hopper 22 itself, there is no need to re-shingle the signatures 11 before the signatures are presented to the accelerator wheel 60.

More specifically, periodic lifting of the upper signatures 11 in the stack 23 is effected by at least two side lifters 65 and preferably by an additional lifter, namely, a rear lifter 66. The two side lifters 65 are located along opposite laterally facing sides of the stack 23 while the rear lifter 66 is disposed adjacent the back of the stack. All three lifters are basically the same and thus a detailed description of one will suffice for all.

Herein, each lifter comprises a roller 68 supported to rotate freely about a generally horizontal axis. Each roller normally is located approximately 4" above the bottom of the stack 23 and normally is located in an inactive position spaced just a very short distance from or in very light contact with the side of the stack. In order to lift the upper group of signatures 11, each roller is swung inwardly toward the stack and is simultaneously moved upwardly. In this way, the freely rotatable rollers move gently in between an upper signature and an underlying signature and then lift the upper signatures at two lateral sides and at the rear to relieve the weight of those signatures from the remaining signatures in the lower end portion of the hopper 22.

Figure 6:
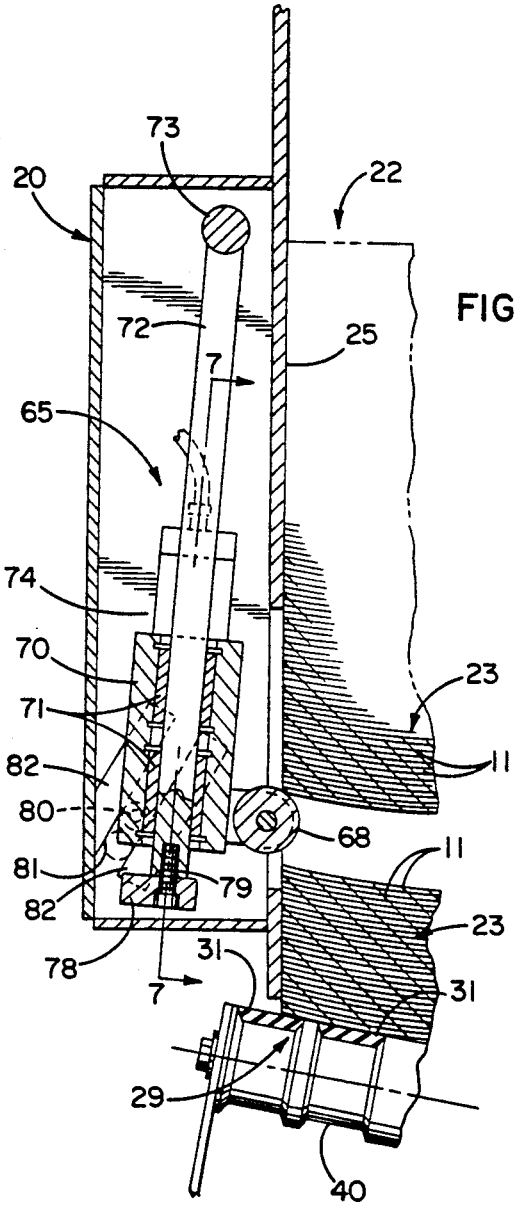
Figure 7:
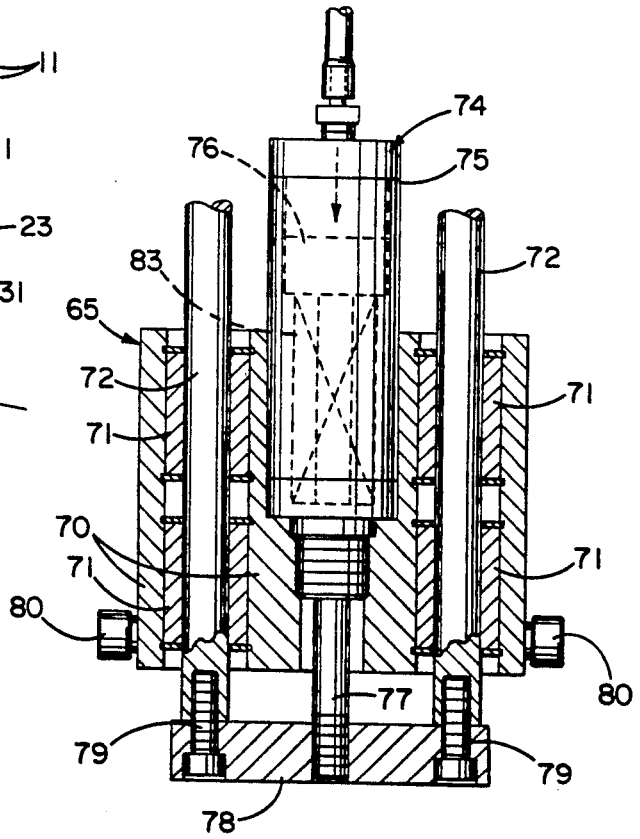
FIG. 7 is an enlarged fragmentary cross-section taken substantially along the line 7—7 of FIG. 6.

To effect the foregoing, each roller 68 is supported by and projects from a block-like carriage 70 (FIGS. 6 and 7). The latter is supported by sleeve bearings 71 to slide upwardly and downwardly on two upright guide rods 72 whose upper ends are supported to pivot on a generally horizontal axle 73, the axle being anchored to the fixed framework 20 of the machine 10. Thus, the rollers 68 of the two side lifters 65 are adapted to swing inwardly toward and laterally away from the sides of the stack 23 while the roller 68 of the rear lifter 66 is adapted to swing forwardly toward and rearwardly away from the rear of the stack.

Swinging of each of the lifters 65 and 66 is effected by a reciprocating fluid-operated actuator 74 (e.g., a pneumatic actuator) having an upright cylinder 75 (FIG. 7) connected rigidly to the upper end portion of the carriage 70 and having a piston 76 slidable upwardly and downwardly in the cylinder. A rod 77 is connected to the piston, extends downwardly from the piston and the carriage 70, and is connected at its lower end to a bar 78 which is fastened to the lower ends of the guide rods 72 by screws 79.

When pressurized air is admitted into the upper end of each cylinder 75, the rod 77, being fastened to the vertically fixed guide rods 72, remains vertically stationary and, as a result, the cylinder and the attached carriage 70 are forced to travel upwardly along the guide rods. Such upward travel is used to force the guide rods and the carriage to swing inwardly. For this purpose, two cam rollers 80 are rotatably supported on the sides of each carriage, each roller being located within an upwardly inclined cam track 81 (FIG. 6) defined between two fixed bars 82. As the carriage 70 travels upwardly, the cam rollers 80 coact with the cam tracks 81 to cause the guide rods 72, the carriage 70 and the lifting roller 68 to swing inwardly about the axis of the axle 73. When the pressure in the upper end of each cylinder 75 is released, a spring 83 (FIG. 7) acts between the piston 76 and the lower end of the cylinder to force the cylinder and the carriage to shift downwardly along the guide rods 72. During such shifting, the cam rollers 80 act against the cam tracks 81 and force the guide rods, the carriage and the lifting roller to swing outwardly.

Figure 3:
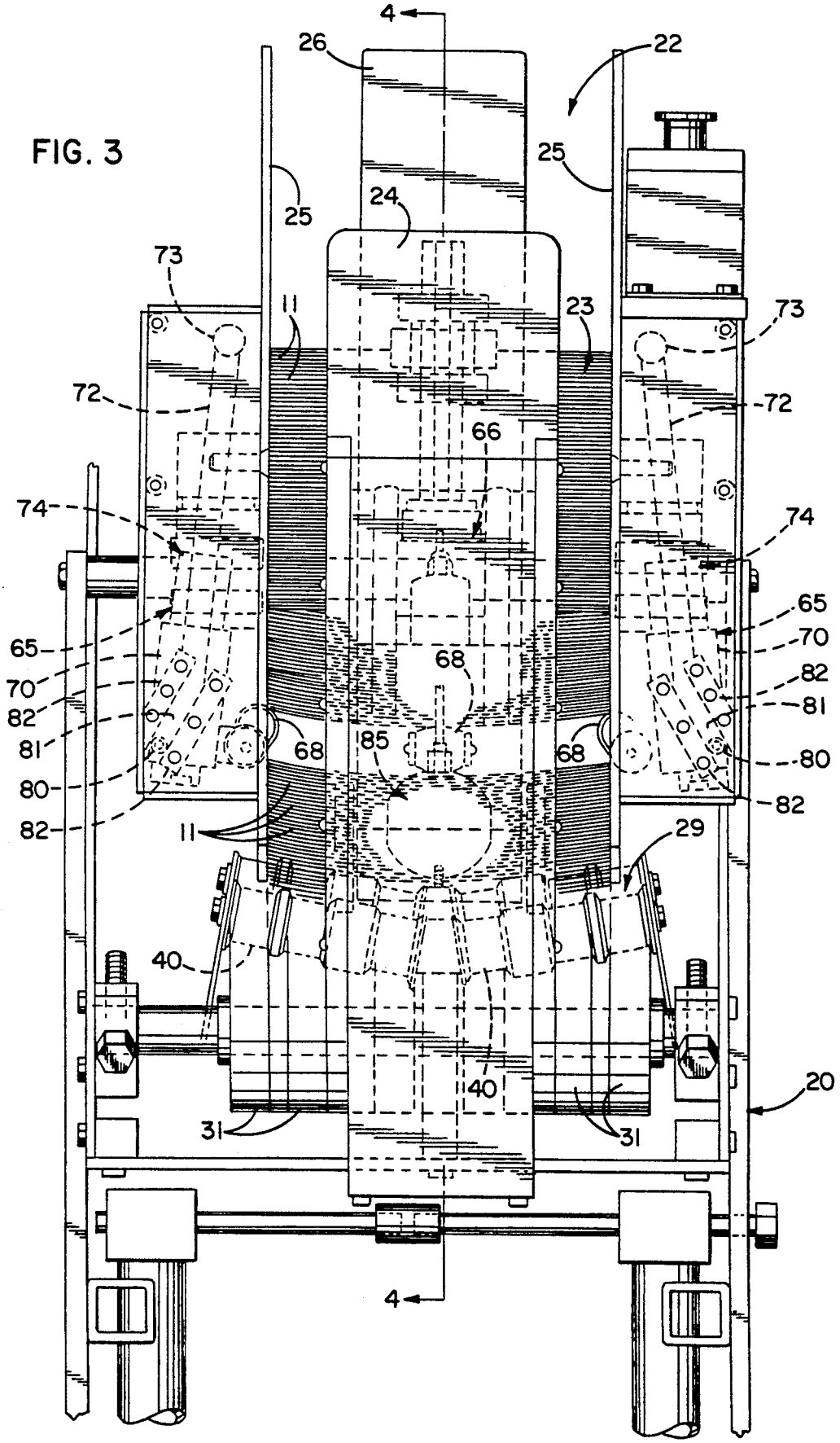
FIG. 3 is an enlarged end view of the upstream end of the machine as seen along the line 3—3 of FIG. i.

With the foregoing arrangement, the rollers 68 of the two side lifters 65 and the rear lifter 66 are located in inactive positions adjacent the sides of the stack 23 when the conveyor belts 31 are idle (see FIG. 4). Just prior to driving of the belts, the cylinders 75 are pressurized to cause the rollers 68 to swing inwardly into engagement with the stack and to lift the sides and rear of an upper group of signatures 11 upwardly from a lower group of signatures as shown in FIGS. 2, 3 and 6. This relieves substantial weight from the lower signatures and, when the belts 31 are subsequently started, allows the belts to strip the signatures one at a time from the bottom of the stack and without danger of adjacent signatures sticking to one another. The shingle 30 is established with a relatively large setback since the vertical force on the signatures in the lower group is comparatively low and thus the tendency of the lowermost signature to frictionally drag the immediately overlying signature out of the stack is significantly reduced.

To further reduce friction between adjacent signatures 11, the signatures are aerated and lubricated as they approach the lower end portion of the stack 23. For this purpose, a large air nozzle 85 (FIGS. 4 and 5) having the general shape of a shoe is positioned at the front side of the hopper 22. The nozzle is centered over the belts 31 and is positioned in light overlying contact with the shingle 30 energizing from the hopper. The rear end portion of the nozzle is formed with a spherically rounded nose having several downwardly and rearwardly angled discharge passages 86 which communicate by way of a larger passage 87 and an air line 88 with a source of pressurized air. Pressurized air jets shoot out of the passages 86 and lubricate adjacent faces of adjacent signatures 11 in the lower end portion of the stack 23 so as to prevent the signatures from sticking together, to help insure that no more than one signature at a time is stripped from the stack and to reduce friction between the lowermost signature and the immediately overlying signature.

To summarize, signatures 11 are stripped from the product hopper 22 and formed into a running shingle 30 by the belts 31, are conveyed upwardly by the vacuum belt 51 and horizontally by the outfeed conveyor 55, and then are launched into the receiver hopper 12 by the continuously rotating accelerator wheel 60. During stripping of the signatures 11 from the hopper 22, the rollers 68 of the side lifters 65 and the rear lifter 66 are in active positions (FIGS. 2, 3 and 6) holding the upper group of signatures in the hopper upwardly from the lower group so as to relieve the weight thereon and enable the belts 31 to establish a reasonably uniform shingle with a large setback and a thin cross-section so as to facilitate one-by-one launching of the signatures into the receiver hopper 12 by the accelerator wheel 60.

When the stack 61 in the receiver hopper 12 rises to a level blocking reflection of the light beam to the photocell 62, the latter produces a signal that sets a timer. Signatures 11 continue to be fed until the timer times out. As an incident thereto, the clutches 37 and 38 are disengaged and the belts 31 are stopped so as to discontinue the feeding of signatures from the product hopper 22. At the same time, pressure is released from the cylinders 75 in order to lower the rollers 68 of the lifters 65 and 66 and allow the rollers to swing out of engagement with the stack 23. This enables the upper group of signatures to drop downwardly and replenish the lower portion of the hopper 22 for the next cycle. Preferably, the compressed air to the aerating shoe 85 also is cut off when feeding of the signatures is stopped so as to avoid exposure of the signatures to moisture in such air.

When the signatures 11 in the receiver hopper 12 drop and allow the photocell 62 to receive the light beam, the cylinders 75 are pressurized to cause the rollers 68 to lift the upper group of signatures 11 in the stack 23 and, at the same time, the air supply to the shoe 85 is re-established in order to furnish lubricating air to the signatures. After a predetermined delay (e.g., about one second), the belts 31 are started to resume the feeding of signatures.

The lifters 65 and 66 not only help establish a shingle 30 with a large setback but also reduce the need of manually massaging and fanning the signatures 11 before the latter are loaded into the hopper 22 since the lifting of the upper signatures together with the provision of the lubricating air decreases the tendency of the signatures to stick to one another as they are stripped from the hopper. Thus, the workers loading the hopper are less likely to suffer from carpal tunnel syndrome.

I claim:

1. A machine for supplying a stream of signatures, said machine comprising a hopper into which an upright stack of signatures is initially loaded, said stack having front and rear sides, having first and second laterally facing sides, and having a bottom, conveyor means for stripping signatures one-by-one from the bottom of said stack and for advancing said signatures forwardly from said hopper as a running shingle, means for lifting a of upper signatures in said stack upwardly from lower signatures in the stack thereby to reduce the weight of the signatures on said conveyor means during stripping of said signatures from said stack by said conveyor means, said lifting means comprising first and second lifters located adjacent said first and second sides, respectively, of said stack and further comprising a rear lifter located adjacent said rear side of said stack, and means for moving each of said lifters between (1) active positions lifting a group of upper signatures in said stack upwardly from the lower signatures in the stack and (2) inactive positions dropping said group of upper signatures onto the lower signatures in the stack.

2. A machine as defined in claim 1 in which each of said lifters comprises a roller supported to rotate about a generally horizontal axis.

3. A machine as defined in claim 1 further including means supporting each lifter to swing inwardly into engagement with said stack and to shift upwardly to lift said upper group of signatures as said lifter is moved from its inactive position to its active position.

4. A machine as defined in claim 3 in which each of said lifters comprises a roller supported to rotate about a generally horizontal axis.

5. A machine as defined in claim 3 in which said supporting means for each lifter comprise rod means supported to swing about a generally horizontal axis, a carriage supported on said rod means to swing with said rod means and to move upwardly and downwardly along said rod means, said lifter being mounted on and movable with said carriage, and said moving means comprising selectively operable actuator means for causing said rod means to swing inwardly and outwardly about said axis and for causing said carriage to move upwardly and downwardly along said rod means.

6. A machine as defined in claim 5 in which the actuator means for each lifter comprises a reciprocating fluid-operated actuator connected between said carriage and said rod means and operable to shift said carriage upwardly and downwardly on said rod means, and cam means on each carriage and operable to swing said rod means inwardly and outwardly in response to upward and downward movement, respectively, of said carriage.

7. A machine as defined in claim 6 in which said actuator comprises an upright cylinder connected rigidly to said carriage and further comprises a rod slidable upwardly and downwardly in said cylinder and connected rigidly to said rod means.

8. A machine for supplying a stream of signatures, said machine comprising a hopper into which an upright stack of signatures is initially loaded, said stack having front and rear sides, having first and second laterally facing sides, and having a bottom, conveyor means for stripping signatures one-by-one from the bottom of said stack and for advancing said signatures forwardly from said hopper as a running shingle, means for lifting a group of upper signatures in said stack upwardly from lower signatures in the stack thereby to reduce the weight of the signatures on said conveyor means during stripping of said signatures from said stack by said conveyor means, said lifting means comprising first and second lifters located adjacent said first and second sides, respectively, of said stack, means for moving each of said lifters between (1) active positions lifting a group of upper signatures in said stack upwardly from lower signatures in the stack and (2) inactive positions dropping said group of upper signatures onto lower signatures in the stack, and means supporting each lifter to swing inwardly into engagement with said stack and to shift upwardly to lift said upper group of signatures as said lifter is moved from its inactive position to its active position, said supporting means for each lifter comprising rod means supported to swing about a generally horizontal axis, a carriage supported on said rod means to swing with said rod means and to move upwardly and downwardly along said rod means, said lifter being mounted on and movable with said carriage, and said moving means comprising selectively operable actuator means for causing said rod means to swing inwardly and outwardly about said axis and for causing said carriage to move upwardly and downwardly along said rod means.

9. A machine as defined in claim 8 in which the actuator means for each lifter comprises a reciprocating fluid-operated actuator connected between said carriage and said rod means and operable to shift said carriage upwardly and downwardly on said rod means, and cam means on each carriage and operable to swing said rod means inwardly and outwardly in response to upward and downward movement, respectively, of said carriage.

10. A machine as defined in claim 9 in which said actuator comprises an upright cylinder connected rigidly to said carriage and further comprises a rod slidable upwardly and downwardly in said cylinder and connected rigidly to said rod means.

11. A machine as defined in claim 8 in which each of said lifters comprises a roller supported on the respective carriage to rotate about a generally horizontal axis.

* * * * *